US009970180B2

(12) United States Patent
Enix

(10) Patent No.: US 9,970,180 B2
(45) Date of Patent: May 15, 2018

(54) SYSTEM FOR MACHINE CONTROL

(75) Inventor: Bruce Wayne Enix, Tipp City, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 1332 days.

(21) Appl. No.: 13/047,026

(22) Filed: Mar. 14, 2011

(65) Prior Publication Data

US 2012/0236142 A1 Sep. 20, 2012

(51) Int. Cl.

| | |
|---|---|
| ***E02F 9/26*** | (2006.01) |
| ***E02F 9/20*** | (2006.01) |
| ***E01C 19/00*** | (2006.01) |
| ***E01C 23/082*** | (2006.01) |

(52) U.S. Cl.

CPC ..... *E02F 9/262* (2013.01); *E01C 19/004* (2013.01); *E01C 23/082* (2013.01); *E02F 9/2045* (2013.01)

(58) Field of Classification Search

CPC ..... G06T 7/0004; E02F 3/847; E02F 3/7609
USPC ..... 348/118
See application file for complete search history.

(56) References Cited

U.S. PATENT DOCUMENTS

| | | | | |
|---|---|---|---|---|
| 4,573,191 | A | 2/1986 | Kidode et al. | |
| 4,733,355 | A * | 3/1988 | Davidson et al. | 701/50 |
| 4,743,771 | A | 5/1988 | Sacks et al. | |
| 4,746,790 | A | 5/1988 | Sorimachi | |
| 4,749,848 | A | 6/1988 | Sorimachi | |
| 4,769,700 | A | 9/1988 | Pryor | |
| 4,916,302 | A | 4/1990 | Sorimachi | |
| 4,924,374 | A | 5/1990 | Middleton et al. | |
| 5,978,015 | A | 11/1999 | Ishibashi et al. | |
| 6,233,005 | B1 | 5/2001 | Cornillault et al. | |
| 6,672,797 | B1 | 1/2004 | Zachman et al. | |
| 6,736,216 | B2 | 5/2004 | Savard et al. | |
| 6,928,384 | B2 | 8/2005 | Kochi | |

(Continued)

FOREIGN PATENT DOCUMENTS

| | | |
|---|---|---|
| CN | 1745385 | 3/2006 |
| CN | 101680198 A | 3/2010 |

(Continued)

OTHER PUBLICATIONS

Mrovlje et al., "Distance measuring based on steroscopic pictures", 9th International PhD Workshop on Systems and Control: Young Generation Viewpoint, Oct. 2008.

(Continued)

*Primary Examiner* — Yulin Sun
(74) *Attorney, Agent, or Firm* — Dinsmore & Shohl, LLP

(57) ABSTRACT

A control system for controlling the movement of a machine element of a construction machine may include a camera support, a plurality of video cameras, a processor responsive to the cameras, and a control for providing control signals. The camera support is adapted for attachment to a movable construction machine. The plurality of video cameras are mounted in a row on the camera support, with the cameras being directed downward to define overlapping fields of view beneath the row. The processor determines the relative position of a point of interest on a surface in the overlapping fields of view of at least two adjacent cameras. The control provides control signals for controlling the movement of the construction machine in dependence upon the relative position of the point of interest.

22 Claims, 5 Drawing Sheets

(56) References Cited

U.S. PATENT DOCUMENTS

| | | | | |
|---|---|---|---|---|
| 7,193,626 | B2 | 3/2007 | Otani et al. | |
| 7,669,354 | B2 | 3/2010 | Aebischer et al. | |
| 7,711,180 | B2 | 5/2010 | Ito et al. | |
| 2003/0226290 | A1* | 12/2003 | Savard | E01C 19/006 37/348 |
| 2004/0213449 | A1* | 10/2004 | Safaee-Rad et al. | 382/141 |
| 2005/0237385 | A1 | 10/2005 | Kosaka et al. | |
| 2009/0256860 | A1 | 10/2009 | Nichols | |
| 2010/0046800 | A1 | 2/2010 | Clark et al. | |
| 2010/0121540 | A1 | 5/2010 | Kumagai et al. | |
| 2010/0201994 | A1* | 8/2010 | Buehlmann | 356/615 |

FOREIGN PATENT DOCUMENTS

| | | | | |
|---|---|---|---|---|
| CN | 101845787 | A | 9/2010 | |
| EP | 1278917 | B1 | 1/2003 | |
| WO | WO 2008/138542 | * | 11/2008 | E01C 19/48 |

OTHER PUBLICATIONS

Chinese Office Action dated May 28, 2014, pertaining to Chinese Patent Application No. 201210055031.8.

German Office Action dated Apr. 1, 2014, pertaining to German Patent Application No. 102012101927.4.

Office Action dated Dec. 31, 2014 pertaining to Chinese Patent Application No. 201210055031.8.

* cited by examiner

SYSTEM FOR MACHINE CONTROL

CROSS-REFERENCE TO RELATED APPLICATIONS

None.

STATEMENT REGARDING FEDERALLY SPONSORED RESEARCH OR DEVELOPMENT

Not Applicable.

BACKGROUND

This relates to construction machines, such as earth grading, bulldozing, and paving machines, in which it is desired to control the position of a blade or other machine element carried by the machine, or to control the direction of machine movement or some other machine function. More specifically, this relates to such machines in which the control is to be effected in regard to a reference surface or point of interest on a reference surface.

In conventional grading vehicles, an operator of the vehicle will set the height of the blade on a surface to be graded at a particular level relative to a reference surface. The reference surface may be an adjacent portion of ground, a standard string line running parallel to the direction of machine movement against which vertical measurements are to be taken, or a roadside curb. In the contact method of following, the string line or other reference surface is actually contacted by a mechanical follower that slides over the reference surface to detect changes in its elevation. For example, a light wire element may be used to track along the top of a string line, whereas a ski-like follower may be used to ride over adjacent curbs or ground areas. The vertical movement of the wire element or the ski-like follower is monitored through an electromechanical linkage, providing an input for the machine control system. Mechanical contact follower systems can encounter rough use from continued movement over various surfaces, making dependability an issue.

Acoustic systems have been used to follow the reference surface without the need for physical contact between the surface and a follower. In some systems, such as shown in the U.S. Pat. No. 4,733,355, to Davidson, an acoustic sensor uses an acoustic signal echo to measure distance, and uses timing windows to determine the approximate round trip time of the return echo. The system is typically used over a period of many hours, with the result that the ambient temperature in the vicinity of the sensor changes, changing the density of the air and the speed of sound. This, in turn, causes the sensed distances to change, since the sensor results depend on travel time of the acoustic pulse. Wind and transient thermal currents can also degrade the accuracy of such a system. Furthermore acoustic systems may have a relative small area over which they can sense the presence of the surface. Finally, the such acoustic systems are only capable of determining the height of the point that is closest to the sensor, i.e., its Z coordinate, and are not able to determine its X and Y coordinates.

SUMMARY

A system for scanning a surface adjacent the path of a construction machine includes a camera support adapted for attachment to a movable construction machine, and a plurality of video cameras. The cameras are mounted in a row on the camera support. The cameras are directed downward to define overlapping fields of view beneath the row. A processor is responsive to the plurality of cameras and determines the relative position of a point of interest on a surface in the overlapping fields of view of at least two adjacent cameras.

Each camera provides an image as a two dimensional pixel matrix. Each pixel corresponds to an associated one of a plurality of vectors in the field of view. The processor determines the relative position of a point of interest by determining the intersection of the vectors that are indicated by the placement of the point of interest within the images from two or more cameras. The camera support may be adapted to extend to the side of the machine. The row may be substantially horizontal. The spacing between adjacent cameras in the row may be substantially uniform with the optical axes of cameras substantially parallel. The row may extend generally in a direction perpendicular to the direction of travel of the construction machine.

A control system for controlling the movement of a machine element of a construction machine may include a camera support, a plurality of video cameras, a processor responsive to the cameras, and a control for providing control signals. The camera support is adapted for attachment to a movable construction machine. The plurality of video cameras are mounted in a row on the camera support, with the cameras being directed downward to define overlapping fields of view beneath the row. The processor determines the relative position of a point of interest on a surface in the overlapping fields of view of at least two adjacent cameras. The control provides control signals for controlling the movement of the construction machine in dependence upon the relative position of the point of interest.

The camera support may extend from the machine to the side of the machine. The row may be substantially horizontal. The spacing between adjacent cameras in the row may be substantially uniform with the optical axes of the cameras substantially parallel. The row extends generally in a direction perpendicular to the direction of travel of the construction machine. The row may extend generally in a direction parallel to the direction of travel of the construction machine. The point of interest is used by the control as a reference surface. The relative positions of a plurality of points of interest may be determined at the same time such that the reference surface is mapped. The relative positions of the plurality of points may be stored.

A construction machine control system may comprise a camera support attached to the construction machine, a plurality of video cameras, a processor, responsive to the plurality of cameras, and a control. The cameras are directed downward to define overlapping fields of view beneath the row. The processor determines the relative position of a point of interest on a surface. The point of interest appears in the overlapping fields of view of at least two adjacent cameras. The control is responsive to the processor and provides control signals for controlling the movement of the construction machine in dependence upon the relative position of the point of interest.

The camera support may extend to the side of the construction machine. The cameras may be mounted in a horizontal row on the camera support with the spacing between adjacent cameras being substantially uniform. The row may extend generally in a direction perpendicular to the direction of travel of the construction machine. The row may extend generally in a direction parallel to the direction of travel of the construction machine. The spacing between adjacent cameras in the row may be substantially uniform with the optical axes substantially parallel. Each camera may provide an image as a two dimensional pixel matrix, with each pixel corresponding to an associated one of a plurality of vectors in the field of view. The processor may determine the relative position of a point of interest by determining the intersection of vectors indicated by the placement of the point of interest within the images from two or more cameras.

DETAILED DESCRIPTION

Figure 1:
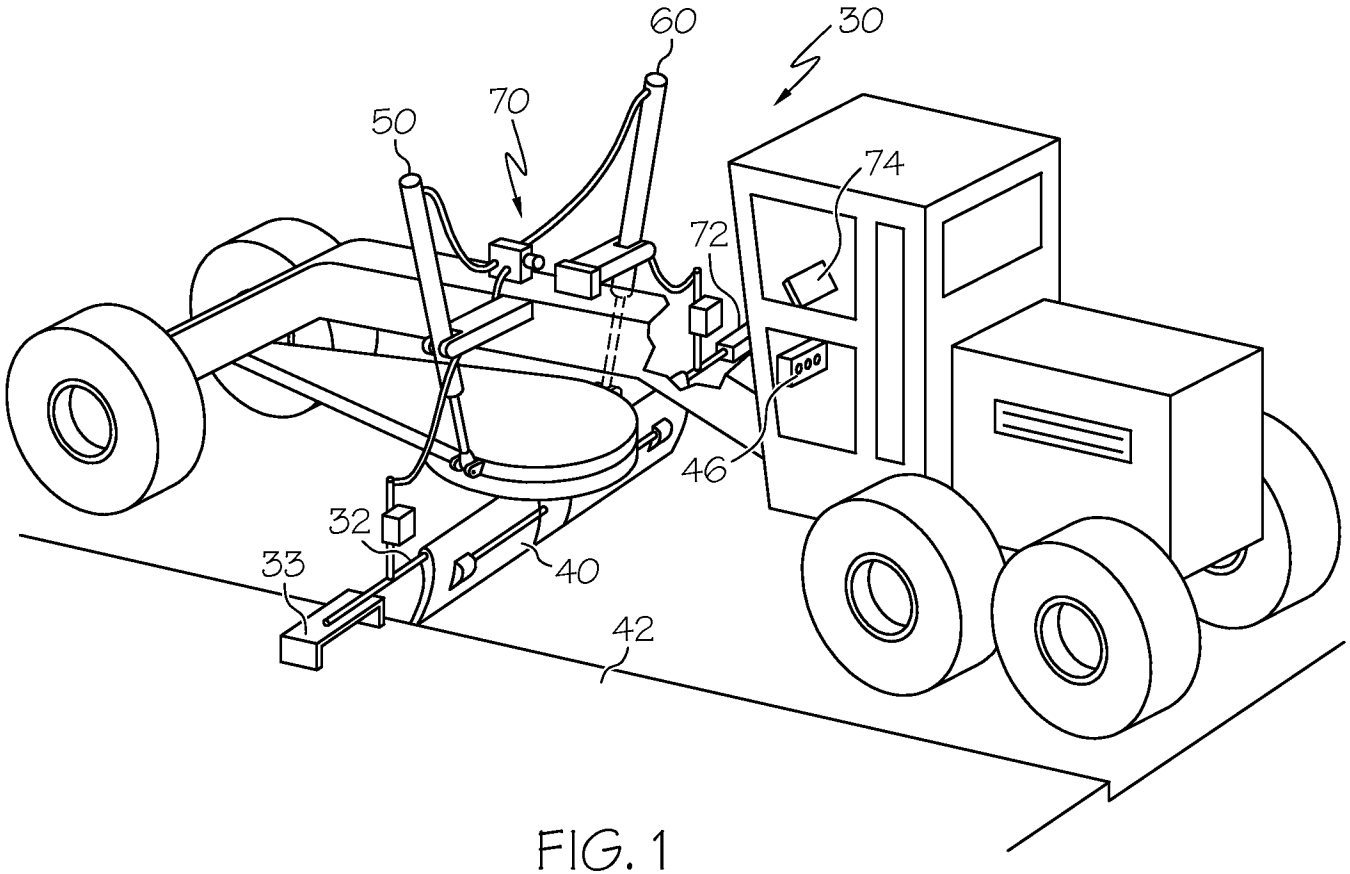
FIG. 1 is a simplified view of a motor grader having an embodiment of the control system, with a portion of the central frame broken away so that the array of cameras on both side of the motor grader can be seen.
Figure 4:
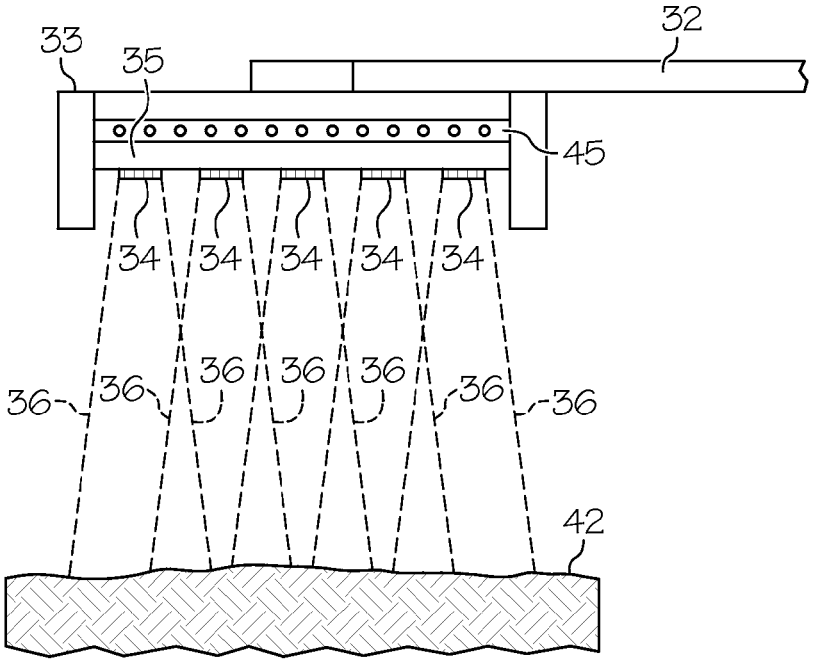
FIG. 4 is an enlarged view of a camera array, shown with the cameras being directed downward toward a surface that is being scanned.
Figure 5:
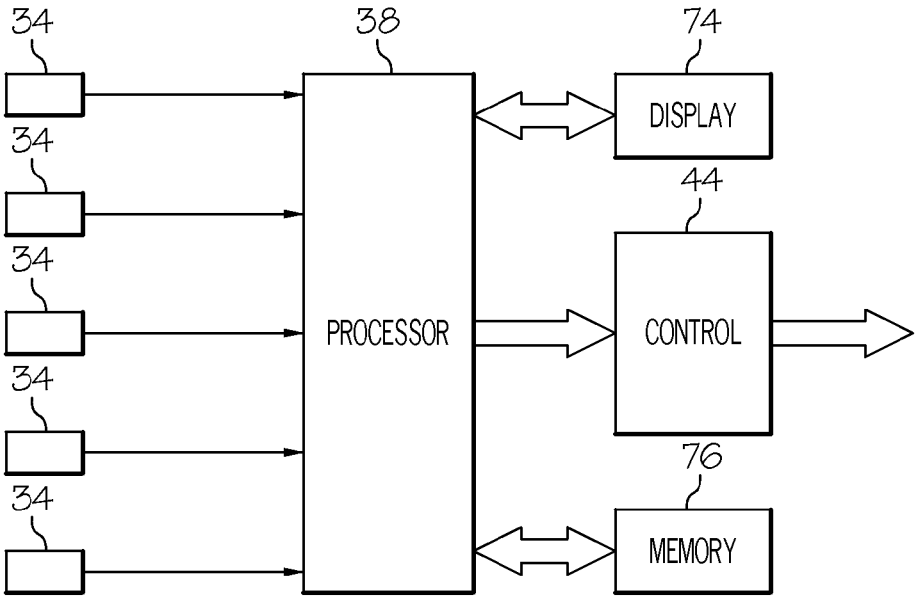
FIG. 5 is a schematic representation of the control system.

FIG. 1 shows a construction machine, illustrated as a motor grader 30, which implements an embodiment of the system for scanning a surface adjacent the path of the construction machine, and controlling a machine element. The system includes a camera support 32 that is adapted for attachment to the movable construction machine, and more specifically in the case illustrated, to the blade 40 of the motor grader 30. The system further includes a camera array 33 having a plurality of video cameras 34 (FIG. 4) that are mounted in a row on the camera support 35 with the cameras being directed downward to define overlapping fields of view, illustrated by dashed lines 36 beneath the row. The cameras may be uniformly spaced in the row, with their optical axes aligned substantially in parallel. The cameras are optically oriented to have their fields of view intersect adjacent cameras at known distances. A processor 38 (FIG. 5) is responsive to the plurality of cameras 34 for determining the relative position of a point of interest on a surface 42 in the overlapping fields of view of at least two adjacent cameras. The processor 38 determines the relative position of the point of interest in three dimensions and then provides this information to control 44 which provides control signals for controlling the movement of the construction machine in dependence upon the position of the point of interest. An illumination strip 45 may be provided as a part of the array 33 to direct additional light onto the surface 42 for operation under low lighting conditions. The strip 45 may include a row of light emitting diodes.

In regard to the motor grader of FIG. 1, the control signals which indicate the vertical position of the reference surface 42 can be used to control the vertical height of the cutting edge of the blade 40. This can be controlled by an operator of the motor grader noting a displayed elevation on display 46, or by an automated control in which the noted vertical position is compared with a desired height and the hydraulic rams 50 and 60 adjusted by hydraulic valve system 70. It will be noted that a second camera array 72 is illustrated as located on the opposite end of the blade. Depending upon the control arrangement, however, such a second camera array may not be required. For example, if the surface referenced for operation of the motor grader is only on one side of the motor grader, a cross slope inclinometer or other sensor may be used to monitor the slope of the blade 40. On the other hand, in some instances reference surfaces, such as defined by string lines, may extend along both sides of the motor grader, and the use of camera arrays on both sides of the motor grader may be desirable.

Figure 6:
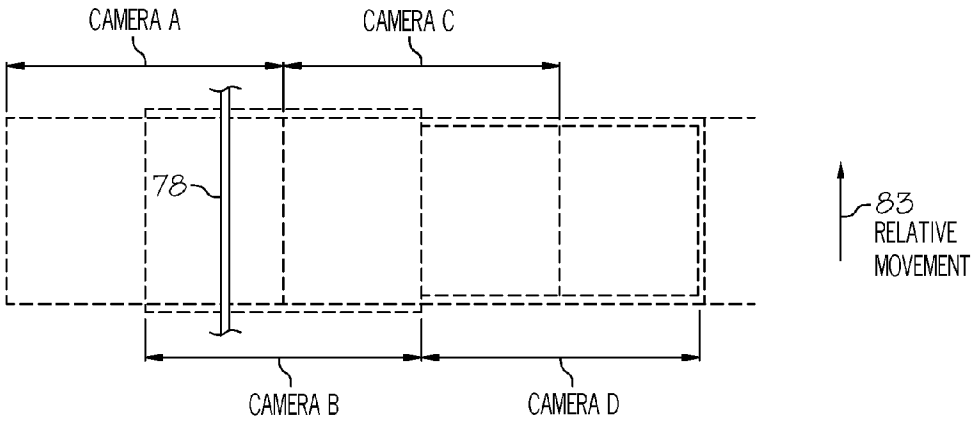
FIG. 6 is a diagrammatic illustration of the overlapping fields of view of a row of cameras A, B, C, and D, illustrating following a string line with the cameras.

As shown diagrammatically in FIG. 6, each camera 34 provides an image to the processor 38 as a two dimensional pixel matrix. Camera A provides an image indicated as A, camera B provides an image indicated as B, camera C provides an image indicated as C, camera D provides an image indicated as D, an so forth. The right half of camera A's field of view overlaps with the left half of camera B's field of view. The right half of Camera B's field of view overlaps with the left half of camera C's field of view, and so forth. It will be apparent from the fields of view illustrated in FIG. 4 that the degree of overlap of the fields of view depends on the relative vertical height of the surface 42. It will also be appreciated that if there is sufficient spacing between the surface 42 and cameras 34, certain areas on surface 42 will be in the field of view of more than two cameras. As seen in FIG. 6, a string line 78 appears in the right half of camera A's field of view and the left half of camera B's field of view.

Each pixel in the image provided by a camera can be considered as corresponding to an associated one of a plurality of vectors in the field of view of that camera. The processor 38 determines the relative position of a point of interest that appears in the field of view of two or more cameras by determining the intersection of those vectors that are indicated by the placement of that point of interest within those images.

The initial point of interest can be specified in several ways. One approach is for the operator to specify a point of interest in the image from a first camera by touching the image at the desired the point on the display 74. The same point of interest must then be located, if possible, in the images provided by the cameras that are adjacent to the first camera. To accomplish this, the images from the cameras to either side of the first camera are correlated with the image from the first camera to locate the point of interest in at least one of those adjacent images. This process is performed by the processor 38. Once the point of interest is located in the second image, the relative position of the point of interest is defined. During operation of the machine, the point of interest is shifted to adjacent points on the same reference surface, permitting the system to follow a string line, for example, even if the string line does not remain the closest surface in the fields of view of the cameras.

A second approach is to defining a point of interest for the processor automatically to select a number of points of interest in a first image, determine the locations of those points of interest in adjacent images, and then determine the closest point of any surface in the fields of view of any of the cameras, with this being provided as the elevation information. This can be accomplished at regular time intervals with no attempt to keep each successive selected point of interest on the same surface. Alternatively, the point of interest may be constrained to occur within a range of heights, above and below the current point of interest. This use of window serves to reject surfaces such as foliage, which might otherwise adversely impact measurement accuracy.

Figure 7:
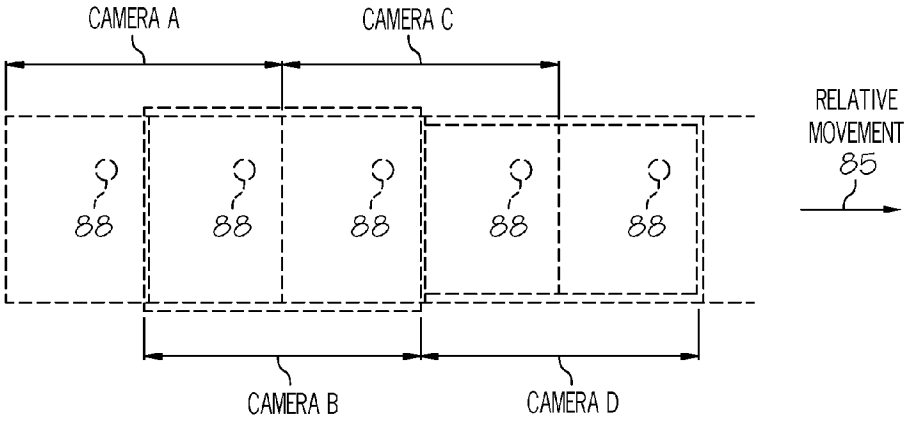
FIG. 7 is a diagrammatic illustration of the overlapping fields of view of a row of cameras A, B, C, and D, illustrating determining the coordinates of a point of interest on a reference surface with the cameras.

In the arrangement illustrated in FIGS. 1, 4, 5, and 6, the camera support is adapted to extend to the side of the machine, the row of cameras is substantially horizontal, the spacing between adjacent cameras in the row is substantially uniform, and the optical axes of the cameras are substantially parallel. The row of cameras extends generally in a direction perpendicular to the direction of travel of the construction machine, indicated by arrow 83. It should be appreciated, however, that any of these factors may be changed, depending upon the type of control that is desired and the machine being controlled. For example, FIG. 7 depicts a control arrangement in which the row of cameras is arranged parallel to the direction of travel of the machine, as indicated by arrow 85. Such an arrangement may be useful when the camera array is being used to replace a mechanical ski of the type that slides along a reference surface, brides small irregularities, and effectively averages surface height over the length of the ski. With the arrangement of FIG. 7, the heights of each of the points of interest 88 may be monitored simultaneously, and then averaged to approximate the operation of the ski. Alternatively, the vertical heights of all portions of the reference surface visible to the cameras may be averaged, if desired. If desired, the surface contours from the entire fields of view of all of the cameras 34 may also be stored in memory 76 for further use, including mapping of the reference surface. Also, if greater spacing between points of interest on the reference surface is desired, several camera arrays may be positioned along the length of a machine.

Figure 2:
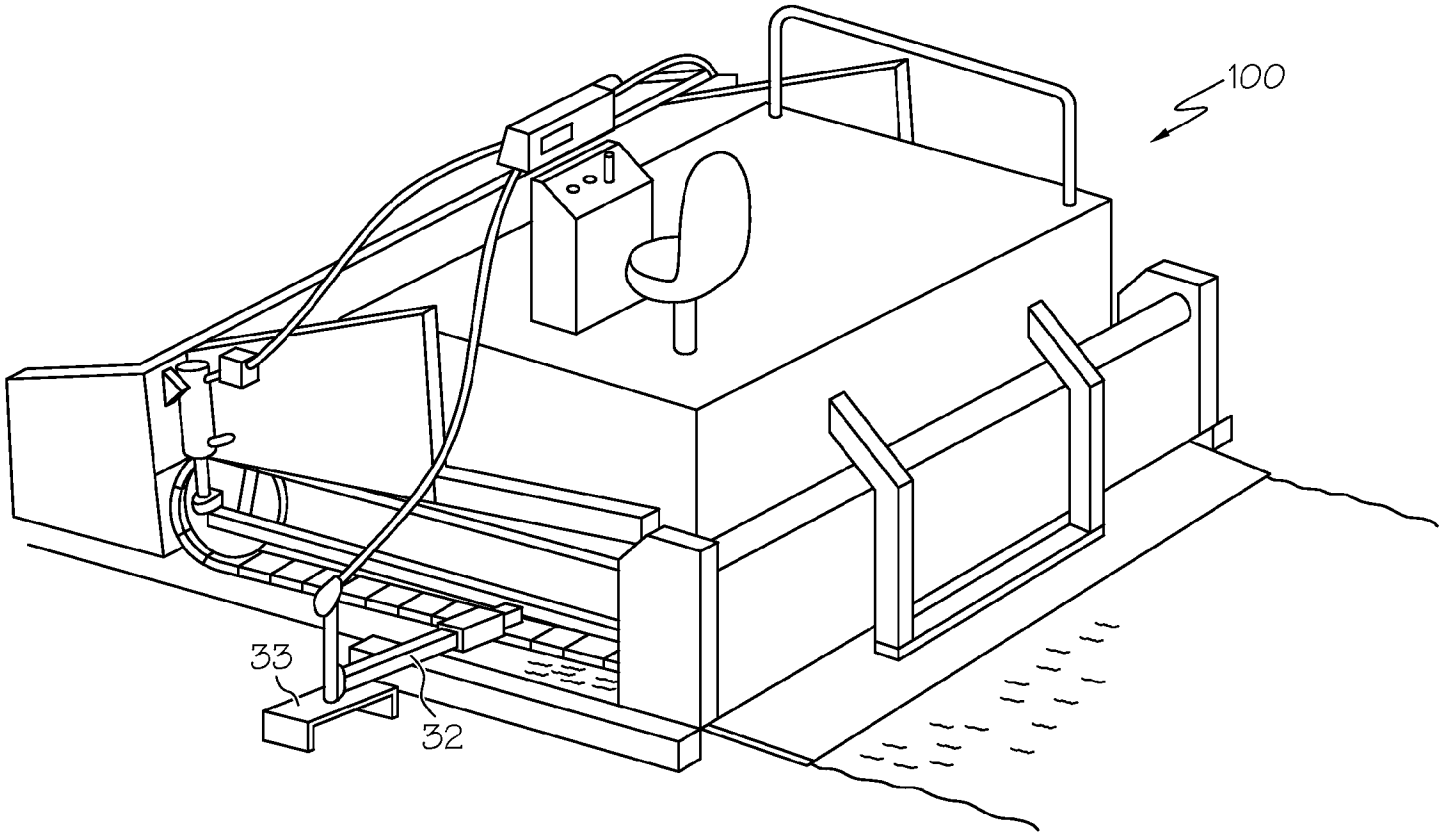
FIG. 2 is a simplified view of a paver having an embodiment of the control system.
Figure 3:
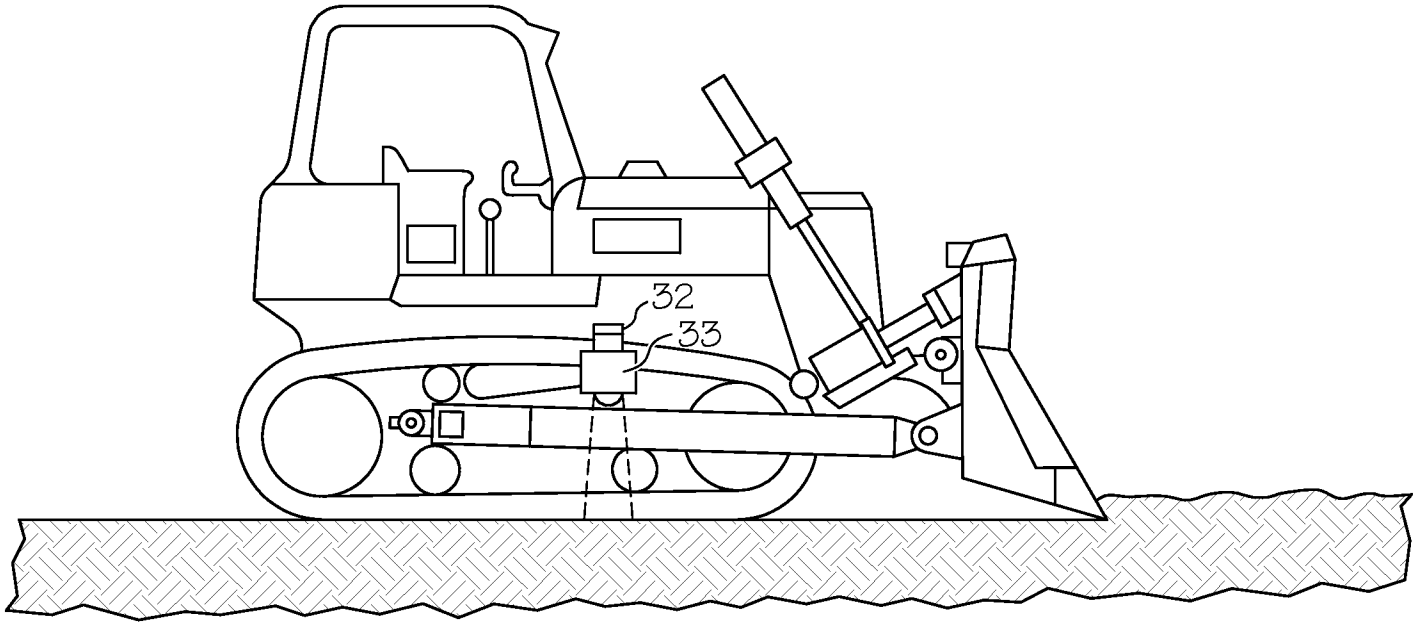
FIG. 3 is a simplified view of a bulldozer having an embodiment of the control system.

Reference is made to FIGS. 2 and 3 which illustrate the construction machine control system in use on a paver 100 and a bulldozer 110. It will be noted that the camera array 33 used with the paver 100 is oriented such that the row of cameras is generally perpendicular to the direction of movement of the paver. It will be appreciated that in some instances it may be desirable to reorient the row such that it is parallel with the direction of movement, as suggested in respect to FIG. 6. It will also be noted that the camera array 33 in FIG. 3 is secured to a camera support 32 that extends from the body of the bulldozer, rather than from the working element, such as the blade. It will be appreciated that the location of the camera array will depend upon the configuration of the machine control, and the other sensors that are available on the machine to permit the position of the working element to be located and controlled.

Other variations may be made in the system. For example, a single ultrasonic or laser rangefinder may be added to the system to provide redundancy and supply an added distance input to the processor to simplify the distance computations. Additionally, since the three dimensional position of the reference surface can be traced with the system, the machine control can use the position data to guide the machine along a desired path over the construction worksite. For example, the system may track a stringline as part of machine guidance, while also adjusting the height of a blade or other machine element based on the stringline. An additional variation is that the system may be used also to monitor ground speed. The system can simply determine how quickly a visual feature passes through the overlapping fields of view of the cameras to determine velocity.

Other arrangements of camera arrays can be used to determine distances stereoscopically. It will be appreciated that other variations in the system disclosed herein may also be made.

What is claimed is:

1. A system for scanning a ground surface in a direction of travel of a movable construction machine, the system comprising:

a camera support adapted for attachment to the movable construction machine;

a plurality of video cameras, said plurality of video cameras being mounted in a row on said camera support with the plurality of video cameras configured to be directed downward toward the ground surface when the camera support is attached to the movable construction machine, and the plurality of video cameras configured to define overlapping fields of view beneath said row, each camera configured to create a two-dimensional pixel image derived from a respective field of view of each camera such that the plurality of video cameras create a plurality of overlapping images; and a processor and a memory communicatively coupled to the processor, the processor configured to execute instructions stored in the memory to:

receive the plurality of overlapping images from the plurality of video cameras;

receive a selection of at least one point of interest from a first two-dimensional pixel image from a first camera;

locate the at least one point of interest in one or more two-dimensional pixel images from one or more video cameras adjacent to the first camera to determine a point of interest of a first elevation;

responsive to said receipt of the plurality of overlapping images from the plurality of video cameras, determine the relative three-dimensional position of the point of interest on the ground surface in the overlapping fields of view of at least two adjacent cameras;

compare the first elevation with a pre-determined desired elevation of a machine element to determine an offset elevation based off at least the relative three-dimensional position of the point of interest; and adjust the machine element based on the offset elevation in the direction of travel.

2. The system of claim 1 in which each camera provides an image as a two dimensional pixel matrix, with each pixel corresponding to an associated one of a plurality of vectors in the field of view, and in which said processor determines the relative three-dimensional position of a point of interest by determining the intersection of vectors indicated by the placement of the point of interest within the images from two or more cameras.

3. The system of claim 1, in which said camera support is adapted to extend to the side of the machine.

4. The system of claim 1, in which said row is substantially horizontal.

5. The system of claim 1, in which the spacing between adjacent cameras in said row is substantially uniform.

6. The system of claim 1, in which said row is configured to extend generally in a direction perpendicular to the direction of travel of said construction machine.

7. A control system for controlling the movement of a machine element of a movable construction machine, comprising:

a camera support adapted for attachment to the movable construction machine;

a plurality of video cameras, said cameras being mounted in a row on said camera support, with the plurality of video cameras configured to be directed downward toward a ground surface when the camera support is attached to the movable construction machine, and said plurality of video cameras configured to define overlapping fields of view beneath said row such that the fields of view intersect the ground surface;

a processor, responsive to said plurality of cameras, for determining the relative three-dimensional position of a point of interest on the ground surface in the overlapping fields of view of at least two adjacent cameras; and a control for providing control signals for controlling the movement of said movable construction machine in a direction of travel on the ground surface in dependence upon the relative three-dimensional position of said point of interest.

8. The control system of claim 7, in which said camera support is configured to extend from said machine to the side of the machine.

9. The control system of claim 8, in which said row is substantially horizontal.

10. The control system of claim 9, in which the spacing between adjacent cameras in said row is substantially uniform.

11. The control system of claim 7, in which said row is configured to extend generally in a direction perpendicular to the direction of travel of said construction machine.

12. The control system of claim 7, in which said row is configured to extend generally in a direction parallel to the direction of travel of said construction machine.

13. The control system of claim 7, in which said point of interest is used by said control as a reference surface.

14. The control system of claim 13, in which the relative positions of a plurality of points of interest are determined at the same time such that said reference surface is mapped.

15. The control system of claim 13, in which the relative positions of said plurality of points is stored.

16. A construction machine control system, comprising:

a camera support attached to the construction machine, a plurality of video cameras, said plurality of video cameras configured to be directed downward toward a ground surface when the camera support is attached to the construction machine, and said plurality of video cameras configured to define overlapping fields of view beneath said row such that the fields of view intersect the ground surface;

a processor, responsive to said plurality of cameras, for determining the relative three-dimensional position of a point of interest on the ground surface, said point of interest appearing in the overlapping fields of view of at least two adjacent cameras; and a control, responsive to said processor, for providing control signals for controlling the movement of said construction machine in a direction of travel on the ground surface in dependence upon the relative three-dimensional position of said point of interest.

17. The construction machine control system of claim 16, in which said camera support is configured to extend to the side of said construction machine.

18. The construction machine control system of claim 16, in which said cameras are mounted in a horizontal row on said camera support with the spacing between adjacent cameras being substantially uniform.

19. The construction machine control system of claim 16, in which said row is configured to extend generally in a direction perpendicular to the direction of travel of said construction machine.

20. The construction machine control system of claim 16, in which said row is configured to extend generally in a direction parallel to the direction of travel of said construction machine.

21. The construction machine control system of claim 16, in which the spacing between adjacent cameras in said row is substantially uniform.

22. The construction machine control system of claim 16, wherein the relative three-dimensional position of said point of interest is associated with a stringline on the ground, and adjustment of a height of a machine element is based on the stringline.

* * * * *